US005476250A

United States Patent [19]

Lonardi et al.

[11] Patent Number: 5,476,250

[45] Date of Patent: Dec. 19, 1995

[54] MACHINE FOR PIERCING A TAPHOLE FOR A SHAFT FURNACE

[75] Inventors: Emile Lonardi, Bascharage; Jean Metz, Luxembourg; Pierre Mailliet, Luxembourg-Howald; Guy Thillen, Diekirch; Radomir Andonov, Mamer, all of Luxembourg; Philippe Malivoir, Thionville, France

[73] Assignee: Paul Wurth S.A., Luxembourg

[21] Appl. No.: 256,932

[22] PCT Filed: Jan. 7, 1993

[86] PCT No.: PCT/EP93/00013

§ 371 Date: Sep. 19, 1994

§ 102(e) Date: Sep. 19, 1994

[30] Foreign Application Priority Data

Jan. 27, 1992 [LU] Luxembourg ..... 88059

[51] Int. Cl.[6] ..... C21C 5/48

[52] U.S. Cl. ..... 266/271; 266/45

[58] Field of Search ..... 266/271, 272, 266/273, 45

[56] References Cited

U.S. PATENT DOCUMENTS

| | | | |
|---|---|---|---|
| 5,069,430 | 12/1991 | Woodings et al. | 266/271 |
| 5,192,489 | 3/1993 | Metz et al. | 266/271 |
| 5,308,047 | 5/1994 | Lonardi et al. | 266/271 |
| 5,333,839 | 8/1994 | Lonardi et al. | 266/272 |
| 5,338,013 | 8/1994 | Lonardi et al. | 266/271 |
| 5,351,939 | 10/1994 | Kremer et al. | 266/271 |

*Primary Examiner*—Scott Kastler

*Attorney, Agent, or Firm*—Fishman, Dionne & Cantor

[57] ABSTRACT

A machine is provided for piercing a taphole for a shaft furnace for applying the piercing rod method. The machine comprises a mounting (20), a drive means (42, 44), a clamp (34) for coupling the drive means to the rod (26) during its extraction. It is characterised by a push-member (34) transmitting the said thrust force to the rear end of the rod (26) during the insertion of the rod (26) into the taphole clay and by intermediate guides (**55*i*) surrounding the rod (26) at several places during the insertion of the rod (26) into the taphole clay. The said guides (55*i*) being successively placed in a position in which they do not hinder the advance of the said push-member (34, 78) on the mounting (20**).

9 Claims, 5 Drawing Sheets

MACHINE FOR PIERCING A TAPHOLE FOR A SHAFT FURNACE

BACKGROUND OF THE INVENTION

1. Field of the Invention

The present invention relates to a machine for piercing a taphole for a shaft furnace, designed for the implementation of the method called "lost rod method" in which, after having blocked the taphole with a taphole clay, a metal rod is driven into this clay, before it has fully hardened, and it is extracted, at the desired time, with a view to opening the taphole. The said machine comprises a mounting for supporting the rod during the said method, a drive means mounted on the mounting so as to develop a traction force or thrust force respectively parallel to the mounting, a coupling member for coupling the said drive means to the rod so as to transmit the said traction force to it during its extraction.

Prior Art

The machines used until now for the implementation of this lost rod method are, in principle, conventional drilling apparatuses, that is to say drilling apparatuses designed for working with a drill bit, which have however undergone appropriate adaptations and modifications for the implementation of the method.

The working member of these machines, which normally serves to drive a cutting drill bit rotationally, must include a coupling clamp for the rod and, especially, a powerful bidirectional pneumatic hammer for delivering the energy necessary for the insertion and extraction of the piercing rod according to the said "lost rod method".

From the document FR-A-2,520,857, a clamp is known which is designed to be mounted on the bidirectional hammer drilling apparatus of a conventional taphole piercing machine. For the operation of extracting a piercing rod embedded in the taphole clay, the normal coupling of the drilling apparatus, serving to communicate a rotational movement to a drill bit, is exchanged with this clamp. The latter then makes it possible to couple the drilling apparatus to the rear end of the piercing rod and to withdraw it by actuating a powerful hammer integral with the drilling apparatus.

In most cases, these piercing machines also preserve the possibility of being able to use the drilling apparatus with a conventional drill bit, either for reforming or moving the taphole, or for drilling the hole conventionally when the lost rod method cannot be used for one reason or another. However, in order to drill the taphole with a conventional drill bit, it is necessarily required to exchange the clamp with the normal coupling of the drilling apparatus, since the jaws of the clamp are not suitable for transmitting a rotational movement to a drill bit.

It will be noted that a powerful hammer, as is used on these machines, is not without disadvantages. Firstly, it exerts considerable stresses and vibrations on the equipment particularly on the rod-coupling clamp, which is, as a result, subjected to rapid wear. It is also extremely noisy, and often does not conform to the ever-stricter standards aiming to reduce the noise level in an industrial environment.

The disadvantages of the hammer could consequently make it desirable to eliminate the percussion during the insertion and extraction of the rod.

From the document EP-A-0,379,018, a piercing machine is known for the implementation of the "lost rod method" which does not use a hammer for the extraction of the rod for piercing the hardened taphole clay. For this purpose, the machine proposed uses a clamp which can move towards the front of the mounting by means of a powerful hydraulic jack whose stroke is, for size-requirement reasons, substantially smaller than the length of the piercing rod to be extracted. This jack causes the clamp to perform several strokes in the vicinity of the front end of the mounting in order to extract the rod by its complete length from the taphole. It follows that the extracted piercing rod—which is hot, deformed and clogged-up—must pass entirely through this extraction clamp. In addition, the extraction clamp is exposed to the projected splashes from the taphole as soon as it is opened. The document EP-A0,379,018 contains no indication how it would be possible to insert, without a hammer, the piercing rod into the taphole clay injected beforehand into the taphole.

The document EP-A-0,379,018 consequently provides only one imperfect solution for the extraction, without a hammer, of the piercing rod and no solution at all for the insertion of the piercing rod, without a hammer, into the taphole clay.

SUMMARY OF THE INVENTION

The aim of the present invention is to provide a machine for piercing a taphole for a shaft furnace, which is designed for an implementation of the "lost rod method", and which makes it possible to dispense with a powerful bidirectional hammer, both for the extraction of the piercing rod from the taphole clay and for its insertion into the taphole clay.

According to the present invention, this objective is achieved by a machine for piercing a taphole for a shaft furnace, comprising a mounting for supporting either a piercing rod or a drill bit, the said mounting comprising a front end which may be arranged facing the taphole and a rear end axially opposite the front end, a drilling apparatus with a coupling which is designed to receive and rotationally drive the drill bit, the said drilling apparatus being mounted so as to slide on the mounting, a drive means mounted on the mounting so as to develop a traction force or thrust force respectively, parallel to the mounting, a clamp mounted on the mounting between the front end of the latter and the drilling apparatus and connected to the drive means, the said clamp comprising a body which is traversed axially by a channel which has a diameter slightly greater than the rod and the drill bit, movable jaws which are arranged around the channel and which are designed so as to be able to grip the rear end of the rod engaged in the channel in order to transmit to it a large traction force when the clamp is moved in the direction of the rear end of the mounting, characterized in that the clamp can be moved by the said drive means along the mounting over a length which corresponds approximately to the length of the rod, in that a key can be engaged in a housing in the body of the clamp so as to block the channel axially and to be able to transmit, to the rear end of the rod engaged in the channel, an axial thrust force when the clamp is moved in the direction of the front end of the mounting, in that the said key, when it is withdrawn from its housing, frees the channel in the clamp so as to be able to pass through this channel with the drill bit and to couple the latter to the coupling of the drilling apparatus located between the clamp and the rear end of the mounting, in that intermediate guides are mounted on the mounting between the front end of the latter and the clamp, the said guides having, on the mounting, operating positions in which they surround the rod at several axially spaced-apart places during its insertion into the taphole blocked beforehand with the taphole clay, and parked positions in which they do not hinder the advance of the said clamp towards the front end of the mounting, and in that these intermediate guides are capable of moving, as the clamp advances towards the front end of the mounting, from the said operating positions into the said parked positions.

According to a main characteristic of the present invention, the metal rod is guided, during the insertion operation, by intermediate guides mounted on the mounting and surrounding the rod at several places. These intermediate supports prevent the rod from starting to buckle when a considerable axial thrust is applied, by the sliding clamp, provided with its key and driven by a powerful drive means, at one end of the rod in order to drive its opposite end into the taphole clay with which the taphole has been blocked beforehand.

It will be noted that intermediate supports on the mounting of a piercing machine are already known for other reasons.

The document GB-A-2,095,381 discloses a piercing machine provided with an intermediate support between a percussion drilling apparatus and the front bearing surface of the piercing machine. The purpose of this intermediate bearing surface is to avoid a cantilevered support of a piercing rod or of a drill bit in the coupling of the procession drilling apparatus. Such a cantilevered support could possibly arise if the front end of the piercing rod or of the drill bit were consumed in the taphole. It will also be noted that the above-mentioned document explicitly recommends the insertion of the piercing rod into the blocking clay by means of a hammer integral with the drilling apparatus.

The document US-A-5,069,430 relates to a machine for piercing a taphole for a shaft furnace, which is equipped exclusively for drilling the taphole by means of a rotary drilling apparatus driving a drill bit with a cutting head. More specifically, it is proposed to work with a drill bit comprising several rod segments coupled to each other. In order to prevent these coupled segments from sagging, when the drill bit is supported on the mounting of the machine, it is proposed to support the drill bit, between the front bearing surface and the drilling apparatus, by a movable support attached to an endless chain. Too great a sag of the drill bit supported on the mounting would, in effect, make the drill bit deviate from its ideal drilling path.

It is important here to note that the drilling of the taphole does not at all give rise to the same problems as the method of opening the taphole by means of a piercing rod embedded in the taphole clay. The reason for this is that the axial forces which the drilling apparatus must transmit to the drill bit are completely negligible in comparison with the forces to be transmitted to the piercing rod in order to insert the latter into the taphole clay, respectively compared to the traction forces to be transmitted to the rod in order to extract the latter from the hardened taphole clay. The document US-A-5,069,430 could therefore provide no contribution to solving the problem which is the basis of the present invention.

The main advantage of the present machine is to be able to insert the rod in one stroke into the taphole clay without having to use a noisy hammer subjecting the equipment and the machine to considerable vibration stresses.

Another advantage of the present invention resides in the fact of being able to extract the piercing rod from the taphole clay by coupling the clamp to the rear end of the rod and by subsequently withdrawing the clamp towards the rear end of the mounting.

An additional advantage of the machine according to the invention is that it is not necessary to dismantle the clamp, serving for the application of the said "lost rod method", when it is desired to drill the taphole by means of a conventional drill bit.

When, during the insertion of the piercing rod into the taphole clay, the clamp advances towards the front of the mounting as the rod is progressively driven into the taphole clay, the said circumferential guides must be removed one after the other, since they would hinder the advance of the clamp on the said mounting.

This may be done manually for example, by each time stopping the movement of the clamp just before it reaches the guide which it risks hitting, by dismantling this guide, and by continuing the insertion movement of the rod up to the following guide.

The present invention, however, also provides preferred solutions enabling the said guides to be put automatically, that is to say without stopping the insertion movement and without any intervention by the machine operator, into a position which does not hinder the clamp as it advances towards the front of the mounting.

In a preferred embodiment, the said guides can for this purpose slide on the mounting. It will then be possible to provide them with a specific driving system for driving them towards a parked position, at the front of the mounting, as they progressively risk hindering the advance of the clamp. However, they could also be advantageously driven or pushed, by the means for driving the clamp or by the clamp itself into a parked position at the front of the mounting as the clamp advances.

It will be appreciated that the present invention also provides preferred solutions for automatically rearranging the said guides sliding on the mounting in their initial operative position, that is to say that which corresponds to the start of the rod insertion operation.

In an alternative embodiment, the said guides each consist of two halves surrounding the rod circumferentially, when they are assembled, over a certain length. When the clamp risks hitting such a guide, the two halves are moved apart laterally by appropriate means, thus freeing the path of the clamp. These guides have the advantage that they do not require, in principle, any parked position at the front of the mounting.

The driving means adopted for the clamp preferably comprises one or more endless chains mounted on the mounting and driven by at least one powerful motor, whose direction of rotation may be reversed so as to ensure both the rod insertion operation and the rod extraction operation. It is however also conceivable to produce these driving means with hydraulic jacks or a screw and nut system, or a combination of several of these systems.

BRIEF DESCRIPTION OF THE DRAWINGS

Other advantages and characteristics will emerge from the detailed description of an advantageous embodiment, described below, by way of example, with reference to the attached drawings in which.

All the Figures comprise the same reference numbers for designating the same components.

DETAILED DESCRIPTION OF THE PREFERRED EMBODIMENTS

Figure 1:
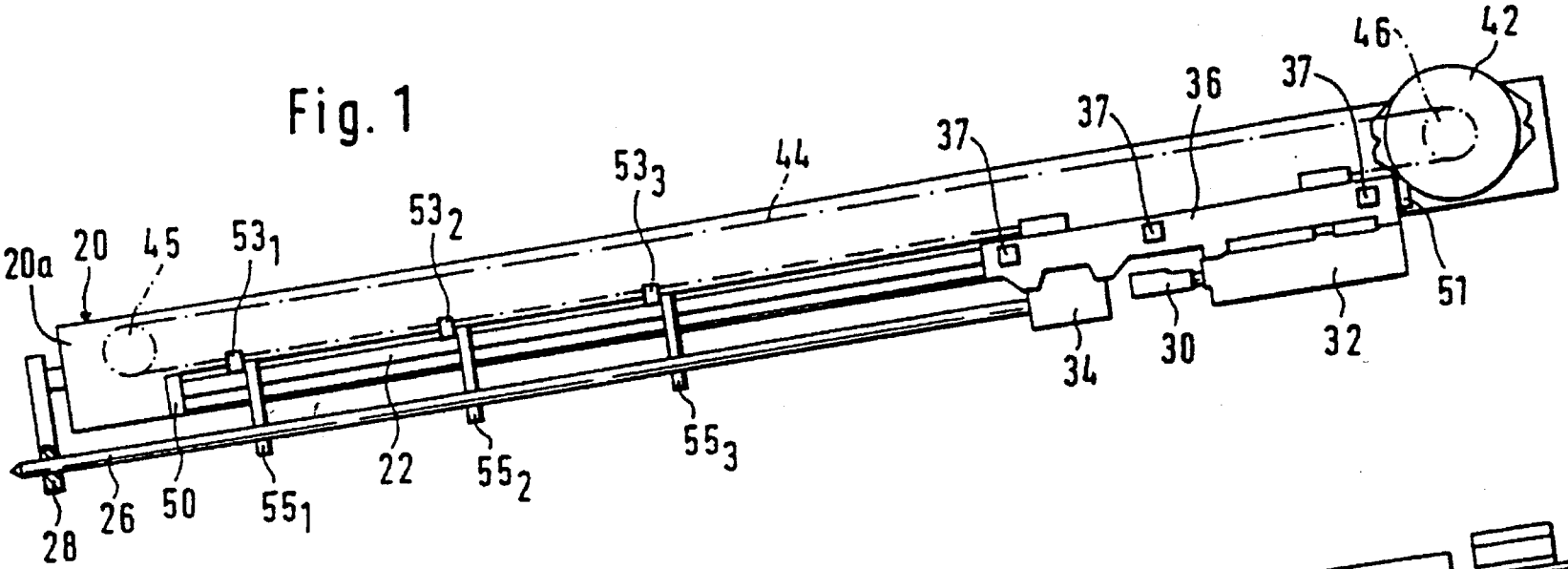
FIG. 1 shows the longitudinal section of a first embodiment of the proposed machine, at the start of the operation of inserting a rod into the taphole clay.
Figure 1A:
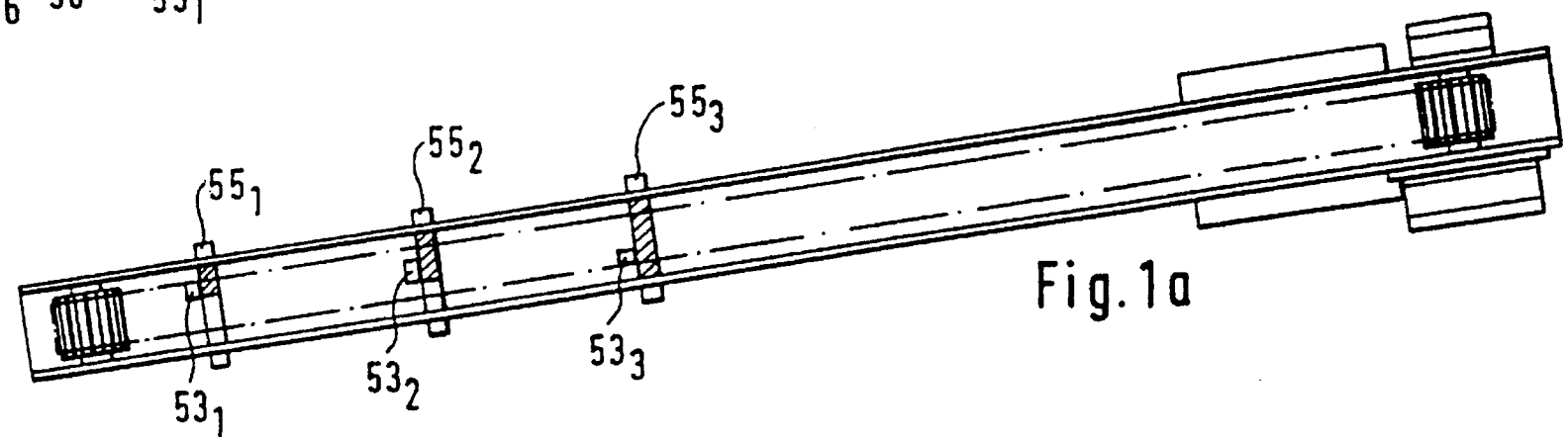
FIG. 1*a* shows a plan view of the machine according to FIG. 1.

For the description of the construction of the machine, FIGS. 1 and 1*a* are referred to. The framework of the piercing machine consists of a mounting 20. This mounting is, for example, supported in a conventional and known manner at the end of a supporting arm (not shown). This supporting arm may pivot about a bracket in order to move the piercing machine between a parked position and an operative position and vice versa.

The mounting 20 may for example be formed by two parallel beams 20*a*, 20*b* joined together. On FIG. 1, only the beam 20*a* can be seen, the beam 20*b* having been left out in order to show more details. The two beams 20*a* and 20*b* comprise, on their inner face, two rails 22 and 24 arranged face-to-face. Only the rail 22 is shown in FIG. 1.

Reference 26 designates a piercing rod, still called "lost rod", used in the said lost rod method described in the preamble.

At the front of the machine there can be seen a support 28 which is preferably a screen-support of the type provided by the European Patent Application EP 0,064,644. This support comprises two flaps mounted at the front of the mounting 20, that is to say opposite the taphole when the machine is in the operative position. These flaps can pivot between an open position facilitating the engagement and the grasping of the rod 26 with a view to extracting the latter and a closed position in which they define an opening for supporting the rod 26. The two flaps thus constitute a support and at the same time form a shield providing protection against the splashes originating from the jet coming out of the taphole when the latter is opened.

At least one endless chain 44 is mounted parallel to the rails 22 and 24, between the two beams 20*a* and 20*b*. This chain 44 is tensioned between a driven toothed wheel 45 mounted at the front of the mounting 20 and a driving toothed wheel 46 mounted at the rear of the mounting 20. The driving wheel 46 is driven by at least one motor 42, fixed onto the mounting 20.

This is preferably a hydraulic motor whose direction of rotation can be reversed by an adapted control system.

Reference 34 designates a clamp intended for the insertion and extraction of the rod 26. This is preferably the clamp described below. The clamp 34 is supported by a carriage 36 sliding freely along the mounting 20, for example by means of runners 37 guided in the rails 22 and 24 which are mounted on the two beams 20*a* and 20*b* of the mounting 20. The carriage 36 is fixed to the endless chain 44 and can be driven by the latter between a stop-piece 50 mounted at the front of the mounting 20 and a stop-piece 51 mounted at the rear of the mounting 20 and vice versa. The travel between the two stop-pieces 50 and 51 is approximately equal to the length of the rod.

It can be seen in FIG. 1 that the carriage 36 can also support a working member 32. This working member which is provided with a coupling 30 for a conventional drill bit usually comprises a rotary percussion drilling apparatus. Its presence is justified in order to be able to drill a taphole, if need be, with the conventional drill bit. It should, however, be emphasized that the working member 32 is not used in the lost rod method and that it could be removed if the conventional drilling of the taphole is never used, or if this drilling can be carried out in another manner. Of course, the working member 32 could also be provided with its own carriage and its own driving means.

Other characteristics of the machine according to the present invention will now be described and its operation for inserting the rod 26 into the taphole and for extracting it therefrom will be studied at the same time.

The rod 26 is preferably loaded into the machine when the latter is in the parked position and when the clamp 34 occupies a position at the rear of the mounting (cf. FIG. 1).

The loading is performed by passing the rod 26 into the clamp 34 and by inserting it into several intermediate guides ($\mathbf{55}_1$, $\mathbf{55}_2$, $\mathbf{55}_3$), which are placed at several places which are spaced almost equidistantly on the mounting 20.

The purpose of these guides (55*i*) is to prevent the rod 26 from buckling when the clamp 34 applies an axial thrust on it during the insertion operation.

It should be noted that the number of intermediate guides as well as their spacings will be determined as a function of the characteristics of the rod (diameter, length, material, etc) and of the force necessary for inserting the rod 26 into the taphole clay. This force is essentially determined by the characteristics of the taphole clay and, inter alia, by its hardening rate.

In order to be effective, each guide (55*i*) must surround the rod 26 in such a way as to prevent the latter from escaping laterally when it is subjected to an axial thrust at its opposite end to the taphole. In addition, the distance between two successive guides must not be too long, else there is a risk of the rod 26 buckling between two guides (55*i*), which could ultimately result in the rod being completely jammed between these two guides.

In order to be able to apply the present method during the insertion of a rod, it is necessary successively to remove the said intermediate guides ($\mathbf{55}_1$, $\mathbf{55}_2$, $\mathbf{55}_3$) from the path of the clamp 34 as it advances towards the front of the mounting 20. This is not a problem per se for the success of the present method, since the more the clamp 34 advances, the more the length of the rod decreases and fewer intermediate guides are required. It would, however, be tiresome to stop the advance of the clamp 34 each time in front of a guide in order to dismantle the latter manually. The present invention thus presents solutions for automatically removing these intermediate guides when the clamp 34 advances towards the front of the mounting 20 in order to drive the guided rod, by means of an axial thrust on its free end, into the taphole clay.

In a first solution, it is proposed to use guides arranged in a sliding manner on the mounting 20. These guides ($55_1$, $55_2$, $55_3$) will then be pushed by the clamp 34 or the carriage 36 towards the front of the mounting 20 as the rod 26 is progressively inserted, that is to say as the clamp 34 advances.

Figure 2:
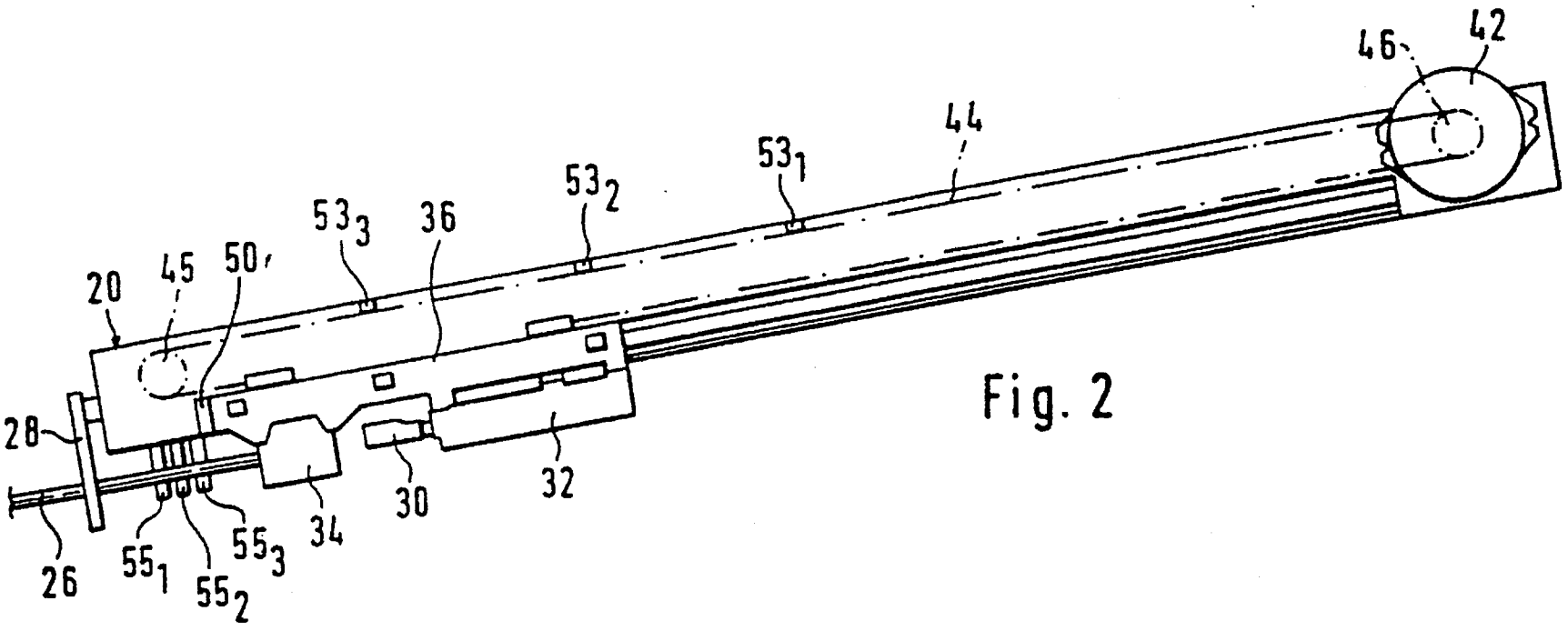
FIG. 2 shows a longitudinal section of the machine according to FIG. 1, after the rod insertion operation is finished.

That is to say that the carriage 36 first encounters the guide $55_3$ on its path, it bears on the latter and pushes it in front of itself. After a certain distance, the guide $55_3$ bears on the guide $55_2$ and the carriage now pushes the two guides $55_3$ and $55_2$ in front of itself. FIG. 2 shows the end of the insertion operation. The carriage 26 is stopped against the stop-piece 50 and the three intermediate guides $55_1$, $55_2$, $55_3$ are located, one against the other, in a parked position in front of the carriage 36.

Figure 3:
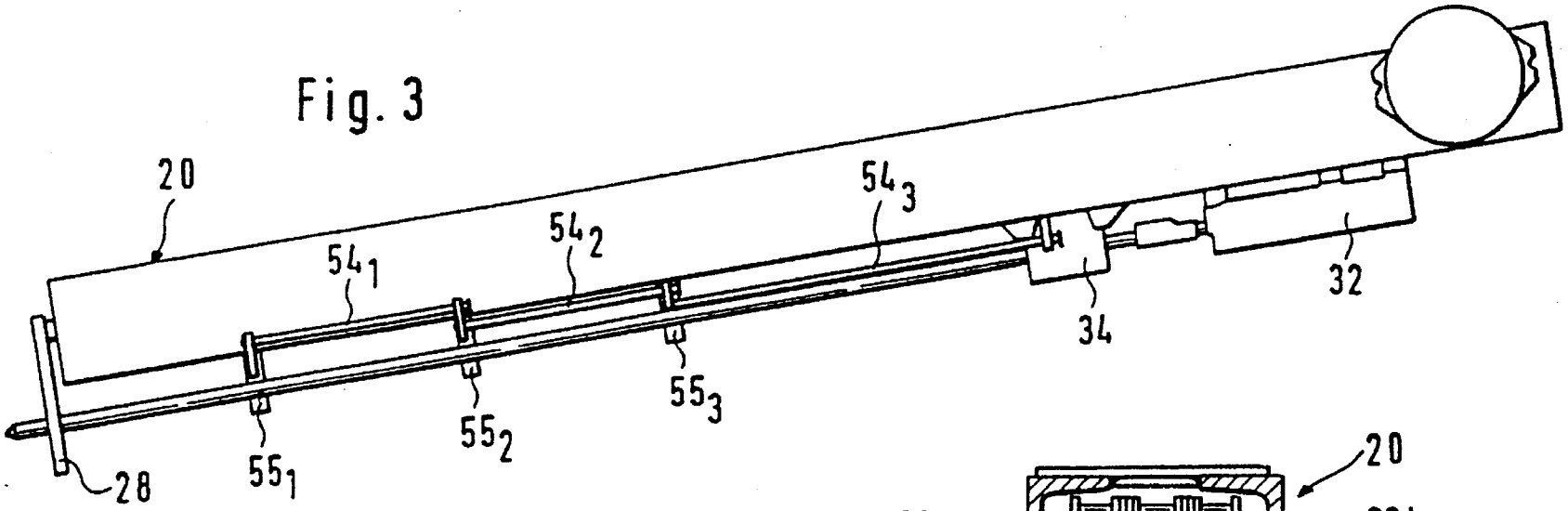
FIG. 3 shows an elevation of a variant of the proposed machine, at the start of the operation of inserting a rod into the taphole clay.

FIG. 3 shows a preferred embodiment of a sliding guide. It comprises a hook 56 which is, for example, engaged with grooves in its foot 57 between the lower flanges of the beams 20*a* and 20*b* forming the mounting. It is to be noted that the mounting of the hook must allow the latter to slide on the mounting 20, while preventing the hook from twisting when it is subjected to out-of-line forces.

In order to be able to house the rod 26 easily in the hook 56, the latter comprises a lateral notch defined by two horizontal edges which are spaced apart by a distance which is slightly greater than the diameter of the rod 26. Before starting the operation of inserting the rod 26 into the taphole clay, this lateral notch is closed by means of a component 58 which is perpendicular to the two horizontal edges, so as to surround the rod 26 closely and prevent the latter from escaping laterally out of the hook 56. The component 58 may be articulated onto the hook 56 and may be advantageously provided with a handle 59 easily so as to be able to open and close the said lateral notch manually. It would however also be possible to fully automate this opening and closing of the said notch.

In a variant of the embodiment of the said guide, the latter consist of two symmetrical halves which may be moved laterally away from the rods 26 during the approach of the clamp 34. This variant is strictly equivalent, with regard to operation, to the sliding guide variant described above; it will therefore not be described in detail below.

It will be appreciated that the present invention also provides a preferred embodiment which enables the guides (55*i*) to be brought from their parked position at the front of the mounting, which they occupy at the end of the operation of inserting the rod into the taphole clay, to their operative position which they must occupy at the start of the said insertion operation.

Figure 4:
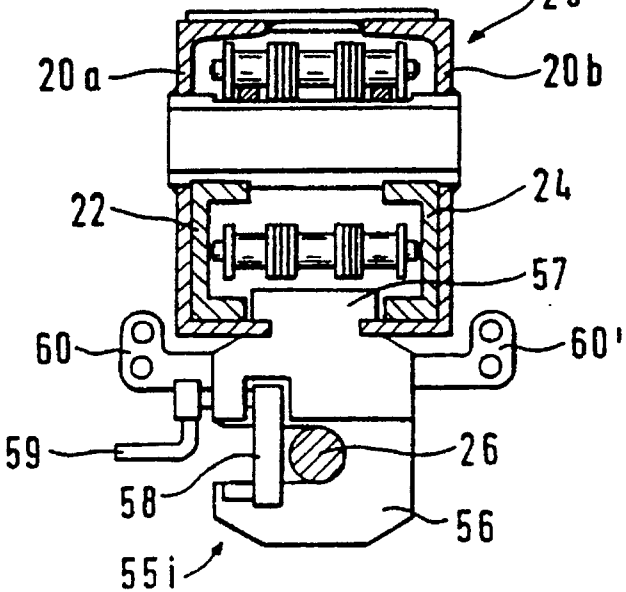
FIG. 4 shows a preferred embodiment of an intermediate guide.
Figure 5:
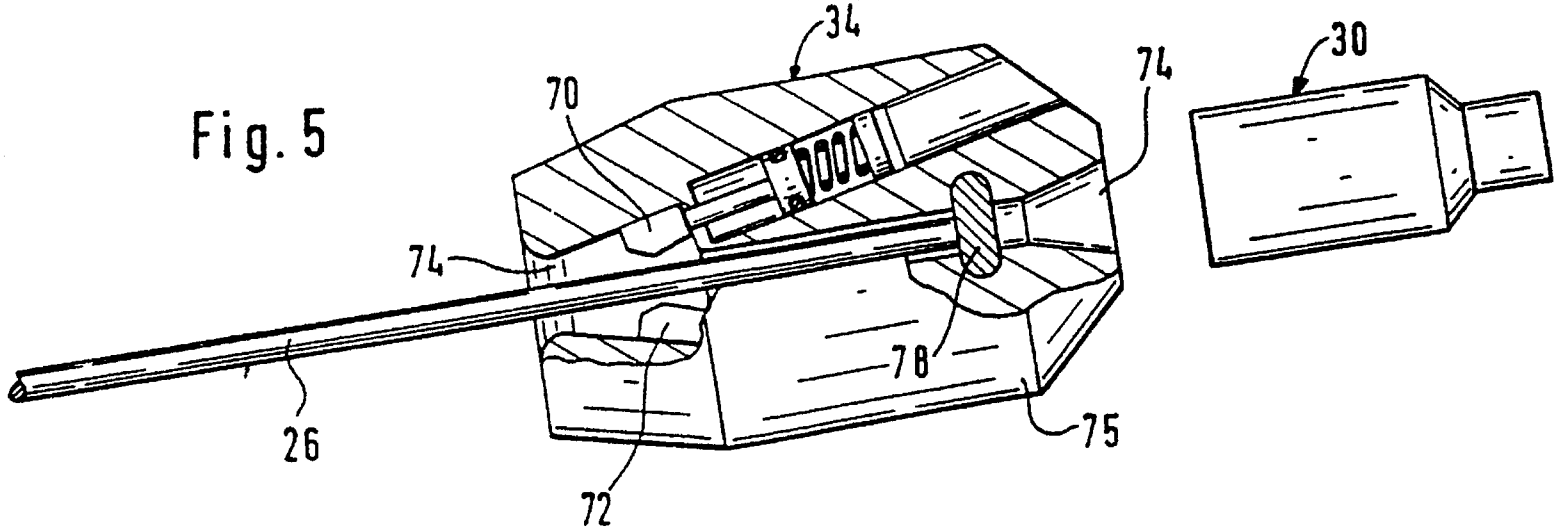
FIGS. 5 and 5*a* show partial sections across a preferred embodiment of a clamp during the rod insertion operation, the sectional planes of the 2 figures being at 90° to each other.
Figure 5A:
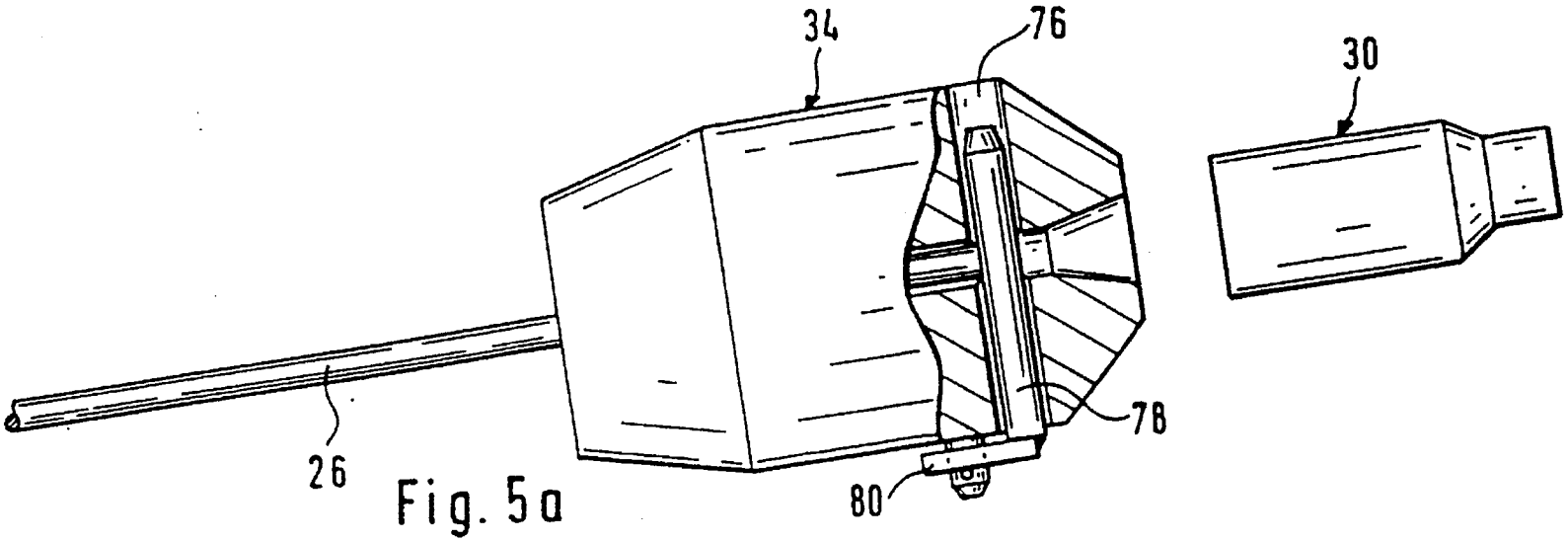

FIG. 1 shows for this purpose fingers $53_1$, $53_2$, $53_3$ which are spaced equidistantly and are firmly attached to the chain 44. These fingers bear on the sliding guides $55_1$, $55_2$, $55_3$ when the chain 44 is put into reverse, that is to say when the carriage 34 is brought from the front of the mounting towards the rear of the mounting. This device therefore enables the sliding guides $55_1$, $55_2$, $55_3$ to be rearranged automatically at the end of the rod insertion operation, by a simple withdrawal of the carriage 36. A similar effect may furthermore be obtained by joining the sliding guides $55_1$, $55_2$, $55_3$ together and to the carriage 36 by means of rods $54_1$, $54_2$, $54_3$, guided in eyelets 60, 60' which are firmly attached to the hooks 56 (cf. FIGS. 3 and 4). These rods could of course be replaced by chains or telescopic rods.

The clamp 34 which is preferably used on a machine according to the present invention is shown in FIGS. 5, 5*a*, 6 and 6*a*.

This clamp 34 comprises a clamp body 75 which is traversed axially by a bore or channel 74 having a diameter which is slightly greater than the rod 26. It can be seen that this is a unidirectional clamp designed for extracting the rod 26, that is to say that it comprises 2 jaws 70, 72 arranged symmetrically around the actual channel 74 and capable of moving obliquely towards the axis of this channel 74 in the direction of the front of the mounting. The result of this is that under the effect of traction towards the rear of the mounting, allowing the rod extraction operation, the jaws 70, 72 automatically clamp onto the end of the rod 26 placed in the channel 74 and thus provide a perfect coupling of the clamp 34 with the rod 26. This is however not the case during the insertion of the rod.

By virtue of a clever system provided by the present invention, this unidirectional clamp may however also be used with the present machine for inserting the rod 26 into the taphole clay. For this purpose, the present invention proposes to install a mechanical stop in the channel 74, behind the jaws 70, in order to provide a bearing point for the rod 26 during the said insertion operation.

It is more precisely proposed to produce this mechanical stop in the channel 74 in such a way that it is easily removable. It is thus possible to pass through the said clamp 34 with a conventional drill bit 27, when it is necessary to drill with the working member 32 placed behind the clamp 34, as shown in FIGS. 6 and 6*a*.

Figure 6:
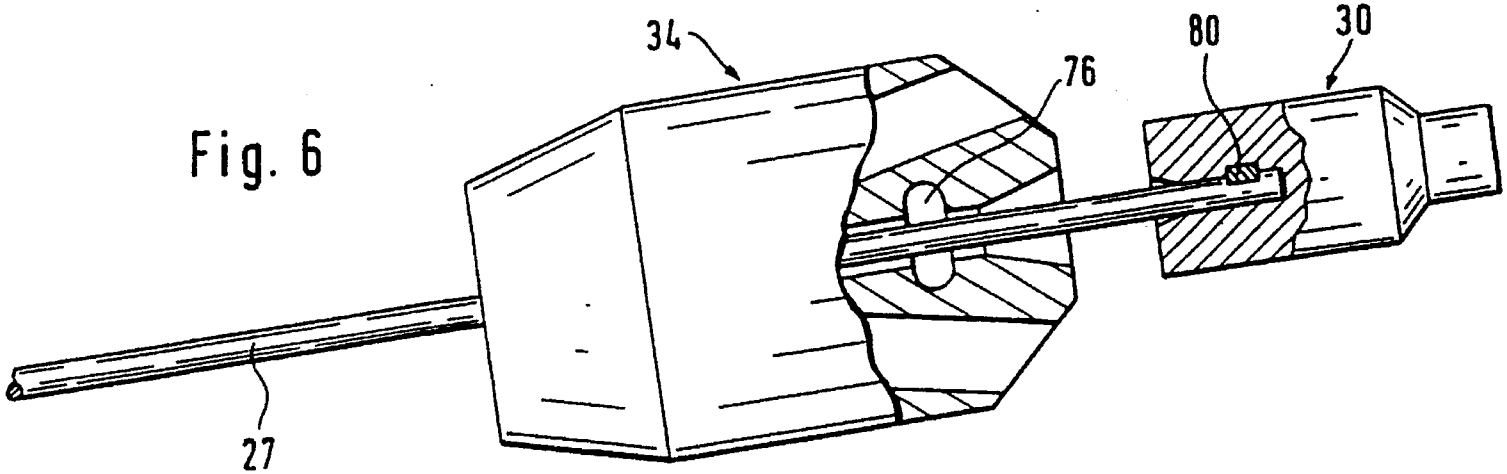
FIGS. 6 and 6*a* show sections identical to the FIGS. 5 and 5*a*, during a drilling operation with a conventional drill bit.
Figure 6A:
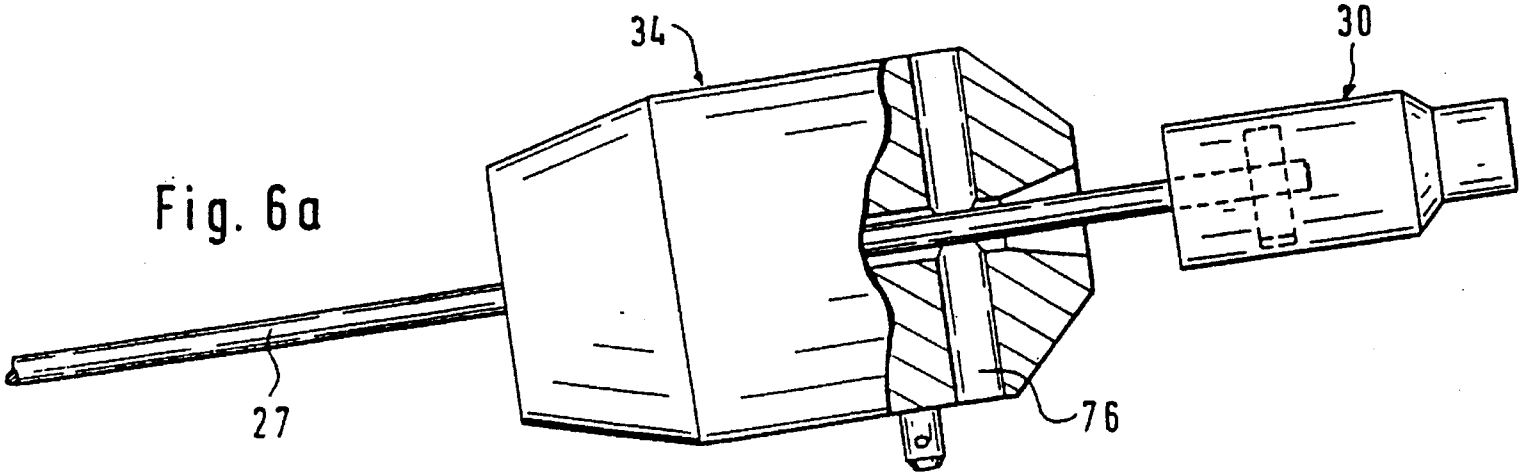

FIGS. 6 and 6*a* show that this movable mechanical stop is produced by inserting a key 78 into a slot 76 which passes perpendicularly through the channel 74. This key 78, whose height is slightly greater than the diameter of the rod 26, is secured at 80 so as to prevent any inadvertent displacement. It is, however, also conceivable to produce this mechanical stop by means of a key 78 actuated, for example, by a pneumatic circuit, which would avoid the need for any human intervention on the clamp itself in order to close or open the said channel 74.

FIGS. 6 and 6*a* show that for a drilling operation, the said key 78 is removed. The drill bit 27 may thus pass through the clamp 34 so as to be inserted into the coupling 30 of the working member 32, where it is locked by an anti-rotation stop 80.

Returning to the method of the lost rod, and more precisely to the operation of inserting the rod 26 into the semi-hardened taphole clay, it is noted that when the rod 26 is passed into the clamp 34 in which the key 78 is in position, and when all the intermediate guides are properly arranged and closed, the motor 42 may be actuated in order to advance the clamp 34 and thus push the rods 26 into the taphole clay. In view of the fact that the rod 26 is surrounded at several places by the guides $55_1$, $55_2$, $55_3$, it is not likely to buckle, even though it is subjected to a considerable axial thrust force. As the carriage 36 advances, the rod 26 is driven into the taphole clay, and the intermediate guides 55*i* which hinder this advance are either pushed forwards, as described above, or moved apart laterally.

For the operation of extracting the rod 26, the free end of the latter is passed through the clamp 34 which is at rest against the stop-piece 50. The clamp 34 is closed by actuating the jaws 70 and 72 which grip the said end of the rod. The motor 42 is then actuated in order to pull the carriage 36 towards the stop-piece 51. There is, of course, no need for intermediate guides $55_1$, $55_2$, $55_3$, since the rod is not subjected to a compression but to a traction. These guides are used only as intermediate supports for the rod as the latter is progressively pulled out of the taphole. It is also important to note that during the last phase of extraction, the screen-support 28 is preferably closed so as to protect the front of the mounting from splashes.

The present invention provides a machine which enables a piercing rod to be inserted into the taphole clay without using a hammer, by exerting a simple powerful axial thrust on the end of this rod, which was judged to be inconceivable until now. In addition, this machine is distinguished by a simple and robust design, and it will be further appreciated that it provides a better protection of the environment with an almost silent operation.

We claim:

1. Machine for piercing a taphole for a shaft furnace, comprising:

a mounting for supporting either a piercing rod or a drill bit, the said mounting comprising a front end which may be arranged facing the taphole and a rear end axially opposite the front end, a drilling apparatus with a coupling which is designed the receive and rotationally drive the drill bit, the said drilling apparatus being mountedso as to slide on the mounting, a driver mounted on the mounting so as to develop a traction force or thrust force respectively, parallel to the mounting, a clamp mounted on the mounting between the front end of the latter and the drilling apparatus and connected to the driver, the said clamp comprising a body which is traversed axially by a channel which has a diameter slightly greater than the rod and the drill bit, and movable jaws which are arranged around the channel so as to be able to grip the rear end of the rod engaged in the channel in order to transmit to it a large traction force when the clamp is moved in the direction of the rear end of the mounting, wherein the clamp can be moved by the said driver along the mounting over a length which corresponds approximately to the length of the rod, and wherein a key can be engaged in a housing in the body of the clamp so as to block the channel axially and to be able to transmit, to the rear end of the rod engaged in the channel, an axial thrust force when the clamp is moved in the direction of the front end of the mounting, and wherein the said key, when it is withdrawn from its housing, frees the channel in the clamp so as to be able to pass through this channel with the drill bit and to couple the latter to the coupling of the drilling apparatus located between the clamp and the rear end of the mounting, and wherein intermediate guides are mounted on the mount between the front end of the latter and the clamp, the said guides having, on the mounting, operating positions in which they surround the rod at several axially spaced-apart places during its insertion into the taphole blocked beforehand with the taphole clay, and parked positions in which they do not hinder the advance of the said clamp towards the front end of the mounting, and wherein these intermediate guides are capable of moving, as the clamp advances towards the front end of the mounting, from the said operating positions into the said parked positions.

2. Machine according to claim 1, wherein the said guides can slide on the mounting.

3. Machine according to claim 2, wherein the said intermediate guides are mounted on the mounting so as to be pushed by the said clamp from their initial operating position to a parked position at the front of the mounting, as the said clamp advances towards the front of the mounting.

4. Machine according to claim 3, wherein each intermediate guide can be driven by the said driver from the parked position at the front of the mounting to its initial operating position, as the said clamp retreats from the front towards the rear of the mounting.

5. Machine according to any one of claim 1, wherein the said intermediate guides consist of hooks, sliding on the mounting and provided with a lateral notch enabling the rod to be housed therein, and wherein the said lateral notch is provided with a component enabling it to be closed laterally after the rod has been housed therein.

6. Machine according to claim 1, wherein the said driver mounted on the mounting comprises at least one endless chain installed on the mounting and at least one drive motor whose direction of rotation may be reversed.

7. Machine according to claim 6, wherein the motor is a hydraulic motor.

8. Machine according to claim 1, wherein the clamp and the drilling apparatus are supported by a common carriage which can slide in rails of the mounting, and wherein this carriage is connected to the said driver.

9. A machine for piercing a taphole for a shaft furnace, comprising:

a mounting adapted to support one of a piercing rod and a drill bit at selected times, said mounting including a front end and a rear end, said front end being arranged facing the taphole and the rear end being axially opposite the front end;

a drilling apparatus slidably engaged on said mounting and adapted to rotationally drive a drill bit when a drill bit is utilized;

a clamp moveably mounted on said mounting between said drilling apparatus and the front end of the mounting, said clamp comprising a body, having an axial channel, said channel having a diameter slightly larger than the drill bit or piercing rod extending within said channel, said channel further including a pair of moveably mounted jaws, capable of gripping a rear end of a rod introduced in said channel, so that said rod can be withdrawn from the taphole when the clamp is supplied with a motive force towards the rear end of the mounting, said clamp further including a housing;

a key associated with said housing, said key being engageable in said housing to block said channel, so as to enable a motive three towards said front end of said mounting supplied to said clamp to be effectively transmitted to the rod to urge the same into the taphole, said key further being disengageable from said housing to allow the through-passage of the drill bit, so that said drill bit may interconnect with said drilling apparatus, and a driver operatively connected to said clamp so as to supply said motive force towards the rear end of the mount, respectively said motive force towards the front end of the mount.

* * * * *